US011002430B2

(12) United States Patent
Litwin

(10) Patent No.: US 11,002,430 B2
(45) Date of Patent: May 11, 2021

(54) SLIDING LAMP

(71) Applicant: Bradley N. Litwin, Philadelphia, PA (US)

(72) Inventor: Bradley N. Litwin, Philadelphia, PA (US)

( * ) Notice: Subject to any disclaimer, the term of this patent is extended or adjusted under 35 U.S.C. 154(b) by 0 days.

(21) Appl. No.: 16/838,177

(22) Filed: Apr. 2, 2020

(65) Prior Publication Data

US 2020/0318811 A1 Oct. 8, 2020

Related U.S. Application Data

(60) Provisional application No. 62/831,117, filed on Apr. 8, 2019.

(51) Int. Cl.

| | |
|---|---|
| ***F21V 14/08*** | (2006.01) |
| ***F21V 23/00*** | (2015.01) |
| ***F21V 11/18*** | (2006.01) |
| ***F21V 23/06*** | (2006.01) |
| ***F21Y 103/30*** | (2016.01) |
| ***F21V 21/30*** | (2006.01) |
| ***F21V 15/01*** | (2006.01) |

(Continued)

(52) U.S. Cl.

CPC ..... *F21V 14/08* (2013.01); *F21V 11/186* (2013.01); *F21V 23/002* (2013.01); *F21V 23/06* (2013.01); *F21V 15/012* (2013.01); *F21V 21/14* (2013.01); *F21V 21/145* (2013.01); *F21V 21/22* (2013.01); *F21V 21/30* (2013.01); *F21Y 2103/30* (2016.08)

(58) Field of Classification Search

CPC .. F21L 4/04; F21L 4/045; F21V 14/02; F21V 14/025; F21V 21/005; F21V 21/22; F21V 21/26; F21V 21/28; F21V 21/30; F21V 21/34; F21V 21/35; F21V 19/02; F21V 15/012; F21S 6/002; F21S 6/003; F21Y 2103/30; F21Y 2103/37

See application file for complete search history.

(56) References Cited

U.S. PATENT DOCUMENTS 4,894,755 A * 1/1990 Chandler ..... B60Q 1/2692 340/472

5,065,299 A * 11/1991 Cohen ..... F16M 11/40 362/431

(Continued)

*Primary Examiner* — Alexander K Garlen

*Assistant Examiner* — Colin J Cattanach

(74) *Attorney, Agent, or Firm* — Birch, Stewart, Kolasch & Birch, LLP

(57) ABSTRACT

A sliding lamp includes a base having an electric conductive unit, a driving mechanism disposed on the base, and a slider having a light source and a light emitting area for emitting light out. The slider is disposed on the base in a way that the driving mechanism is capable of driving the slider to slide between a closed position and a wide-open position. When the slider is at the closed position, the light emitting area is completely covered and the light source is electrically disconnected from the electric conductive unit. In the process that the slider slides from the closed position to the wide-open position, the light source is electrically connected with the electric conductive unit and the light emitting area is gradually exposed. Therefore, the sliding lamp is turned on/off or adjusted in brightness by sliding and thereby changed in shape thereof at the same time.

7 Claims, 8 Drawing Sheets

(51) Int. Cl.
*F21V 21/22* (2006.01)
*F21V 21/14* (2006.01)

(56) References Cited

U.S. PATENT DOCUMENTS 5,163,650 A * 11/1992 Adams ..... B60Q 1/2657 248/354.4
5,524,398 A * 6/1996 Miller ..... B60P 3/18 182/207
5,564,815 A * 10/1996 Littman ..... F21S 8/028 362/147
5,695,271 A * 12/1997 Zeller ..... F21V 21/22 362/191
6,543,915 B1 * 4/2003 Chen ..... F21S 8/02 362/365
7,600,899 B2 * 10/2009 Chen ..... F21V 21/30 362/269
2010/0232148 A1 * 9/2010 Sharpley ..... B62D 63/08 362/183
2013/0188373 A1 * 7/2013 Lin ..... F21V 21/116 362/410
2015/0062901 A1 * 3/2015 Chen ..... F21S 4/24 362/249.04
2016/0369959 A1 * 12/2016 Ngai ..... F21S 6/003
2019/0346122 A1 * 11/2019 Proeber ..... F21V 23/002

* cited by examiner

SLIDING LAMP

BACKGROUND OF THE INVENTION

1. Field of the Invention

The present invention relates generally to lamps and more particularly, to a sliding lamp which is turned on, turned off and adjusted in brightness by sliding.

2. Description of the Related Art

The conventional lamps usually have a push button for the user to turn on or turn off the lamp by pushing the push button, or have a knob for the user to turn on or turn off the lamp or adjust the brightness by turning the knob. When the lamps are controlled in the aforesaid manner, only the brightness is changed, but the shape of the lamp remains unchanged. Such lamps are monotonous in shape and control manner thereof.

SUMMARY OF THE INVENTION

Therefore, it is an objective of the present invention to provide a sliding lamp which is turned on, turned off or adjusted in brightness by sliding and thereby changed in shape thereof at the same time.

To attain the above objective, the present invention provides a sliding lamp which includes a base provided therein with an electric conductive unit, and a slider provided therein with a light source and having a light emitting area for emitting light out. The slider is disposed on the base in a way that the slider may be mechanically set in motion by manual or motor driven mechanism to slide relative to the base between a closed position and a wide-open position. When the slider is located at the closed position, the light emitting area of the slider is completely covered by the base and the light source is electrically disconnected from the electric conductive unit of the base. In the process that the slider slides from the closed position to the wide-open position, the light source is electrically connected with the electric conductive unit of the base and the light emitting area is gradually exposed.

As a result, the electric conductive unit of the base is adapted to be electrically connected to a power source for supplying power to the light source. When the slider is located at the closed position, the light source is electrically disconnected from the power source, so that the lamp is turned off. When the slider slides a little bit toward the wide-open position from the closed position to make the light source electrically connected with the electric conductive unit, the lamp is turned on and the light source emits light through the light emitting area of the slider. The farther the slider slides from the closed position, the more of the light emitting area is exposed and thereby the more light is emitted out. When the slider is located at the wide-open position, the most of the light is emitted out and the lamp is in the brightest state. In other words, when the sliding lamp is controlled to slide, the lamp may be turned on or off or adjusted in brightness and the shape of the lamp is changed at the same time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
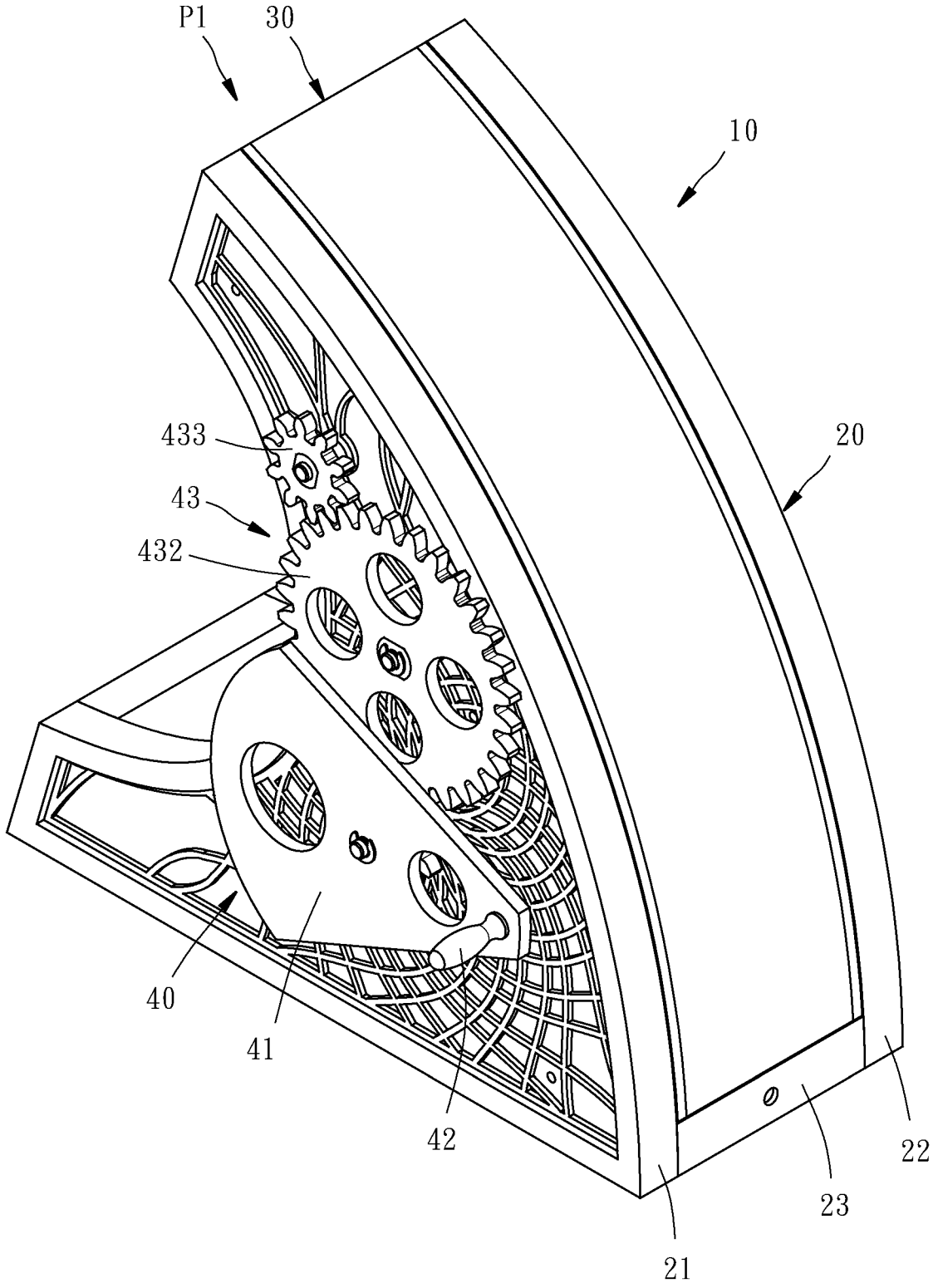
FIG. 1 is an assembled perspective view of a sliding lamp according to a preferred embodiment of the present invention, showing the state that a slider of the sliding lamp is located at a closed position.

Referring to FIGS. 1-4, a sliding lamp 10 according to a preferred embodiment of the present invention includes a base 20 for standing on the desk steadily, a slider 30 for sliding relative to the base 20, and a driving mechanism 40 for driving the slider 30 to slide.

The base 20 primarily includes a front plate 21, a rear plate 22, an arc-shaped housing 23 fixed between the front and rear plates 21 and 22, and an electric conductive unit 24 fixedly disposed in the housing 23. The electric conductive unit 24 includes an elongated positive electrode 241 and an elongated negative electrode 242 shaped identically to each other. Each of the electrodes 241 and 242 is an elongated sheet metal having an arc section 243, a vertical section 244, a horizontal section 245, and a slot-shaped through hole 246 provided on the arc section 243 and located adjacent to the vertical section 244. The housing 23 includes a bottom container 231 wherein the electric conductive unit 24 is located, and a top cover 232 covering the electric conductive unit 24 and having two elongated grooves 233 located correspondingly to the arc sections 243 of the electrodes 241 and 242 respectively. The bottom container 231 has a through hole 234 located on the right side of the base 20 and adjacent to the bottom surface of the base 20. The horizontal sections 245 of the electrodes 241 and 242 are adapted to be electrically connected to the positive and negative electrodes of a power source (not shown) respectively through the through hole 234.

Figure 2:
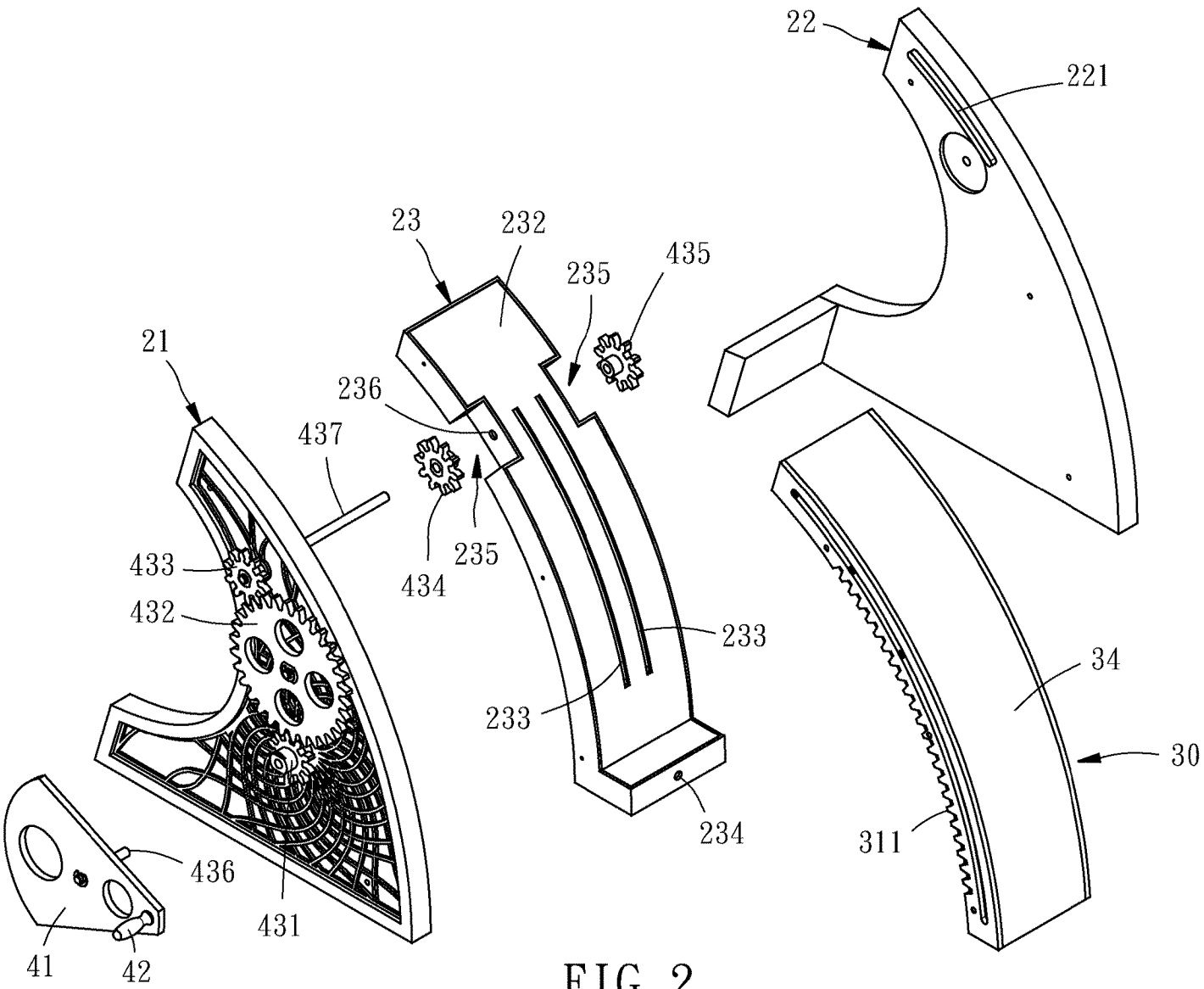
FIGS. 2-4 are exploded perspective views of the sliding lamp.
Figure 3:
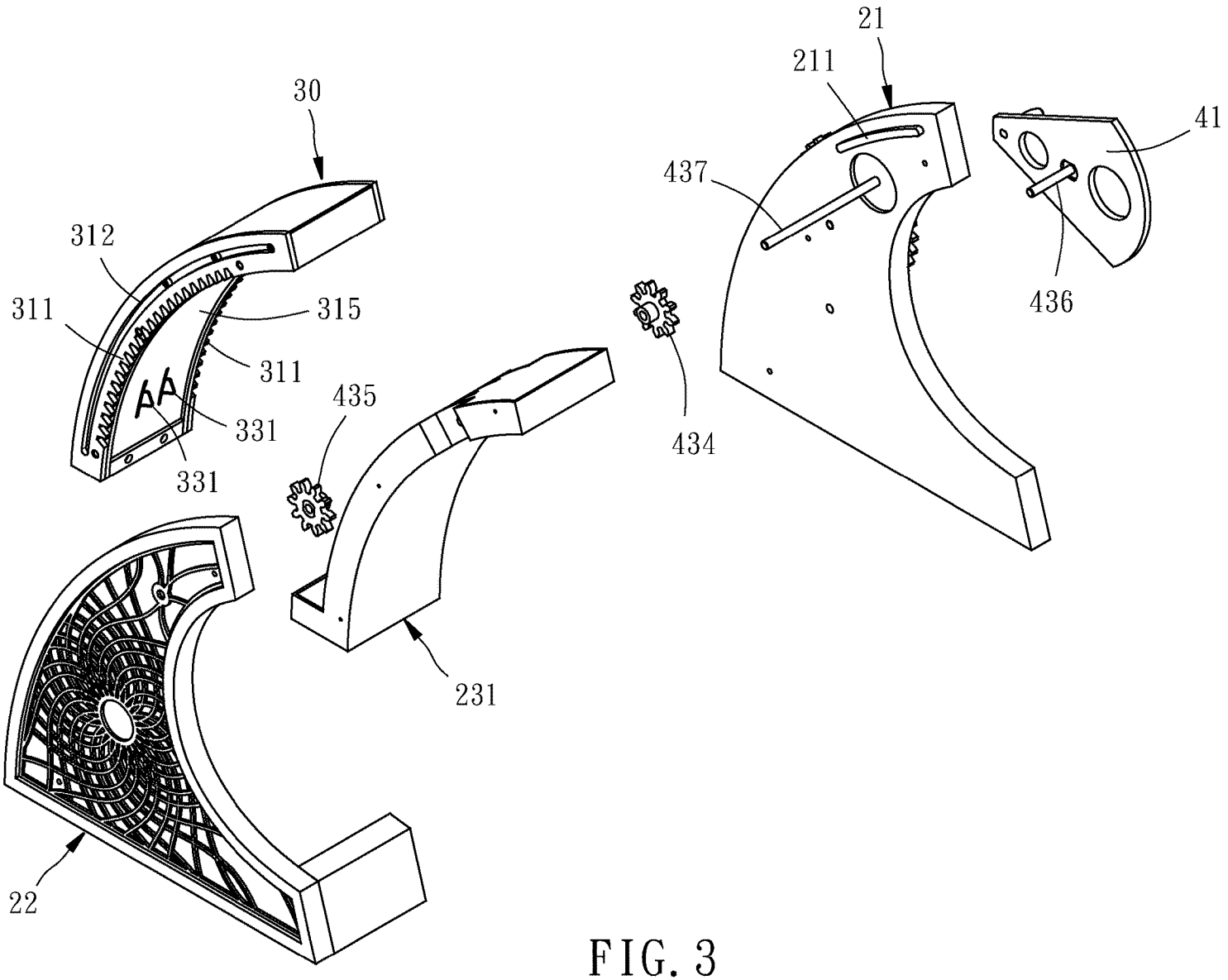
Figure 5:
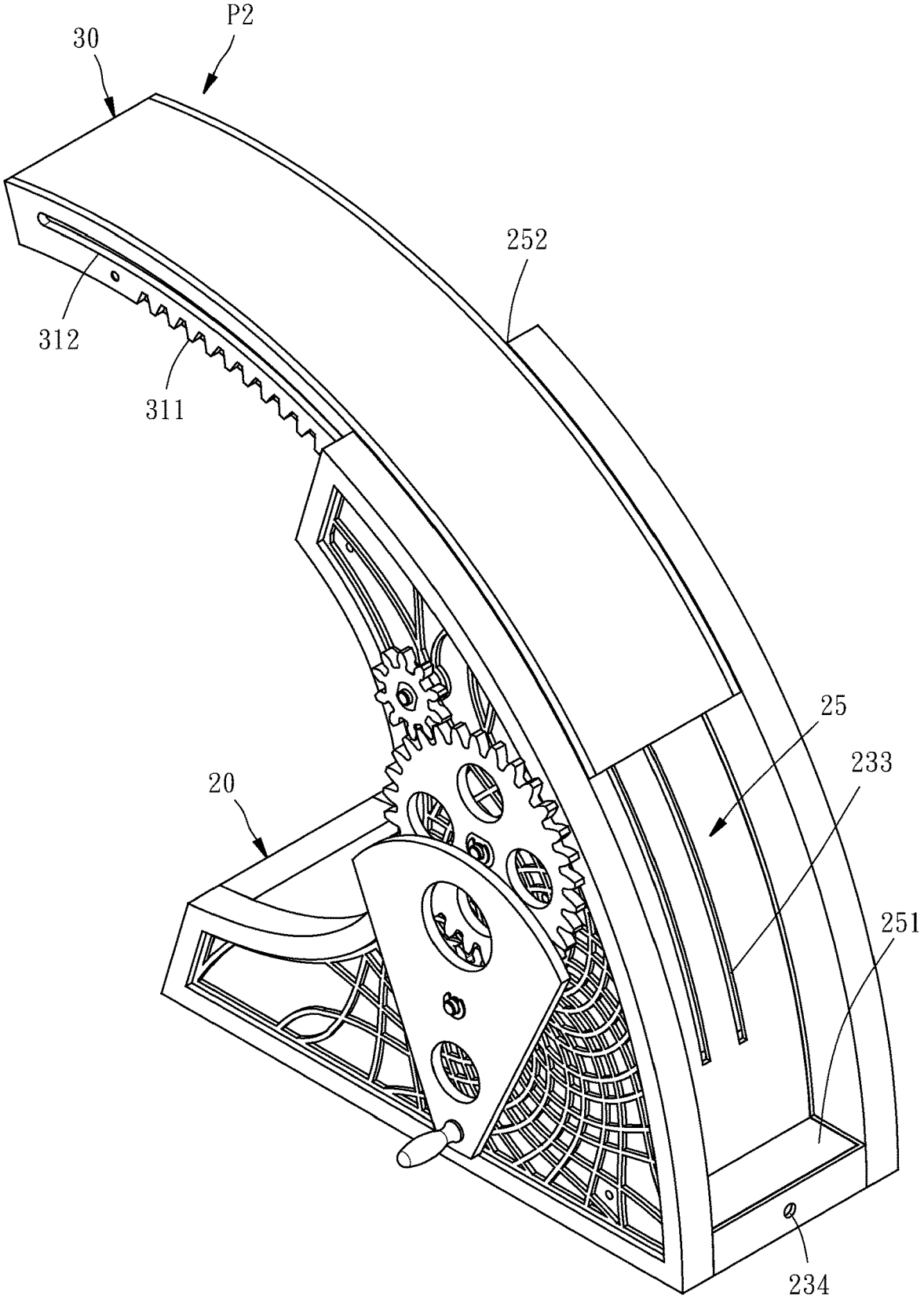
FIG. 5 is another assembled perspective view of the sliding lamp, showing the state that the slider of the sliding lamp is located at a wide-open position.

As shown in FIG. 2, the housing 23 is shaped with two recesses 235 located on the front and rear sides of the housing 23 respectively, and provided with an axial hole 236 communicating with the two recesses 235. As shown in FIG. 5, the base 20 is configured with a concave track 25 extending from the top to the right side of the base 20. The concave track 25 is provided with a closed end 251 located at the right side of the base 20 and adjacent to the bottom surface of the base 20, and an open end 252 located at the top of the base 20. The front plate 21 is provided on the rear surface thereof with a curved guide 211 as shown in FIG. 3, the rear plate 22 is provided on the front surface thereof with a curved guide 221 as shown in FIG. 2, and the curved guides 211 and 221 are both located in the concave track 25. The concave track 25 and the slider 30 are both arc-shaped and complementary to each other, and the slider 30 is disposed in the concave track 25.

Figure 4:
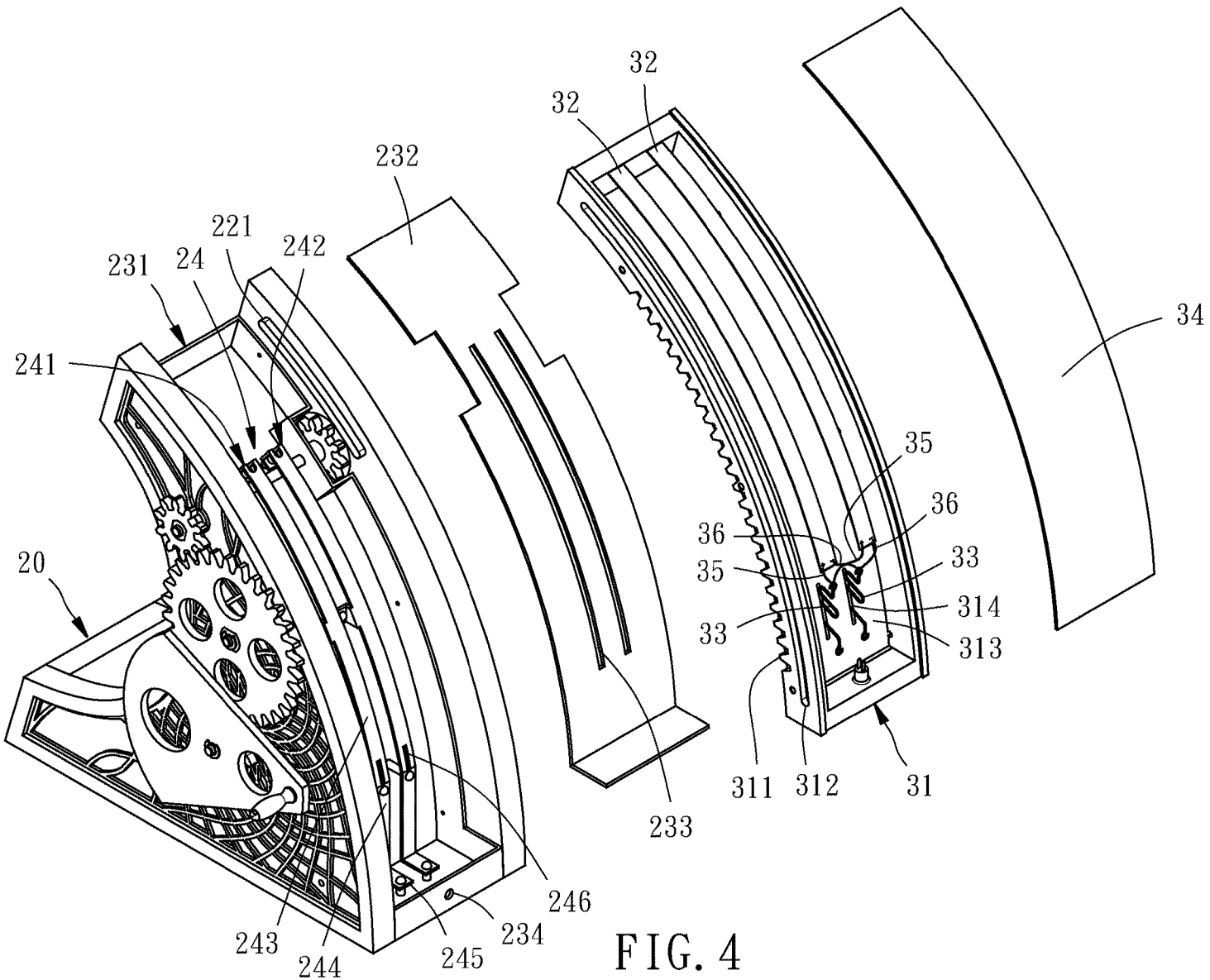

As shown in FIG. 4, the slider 30 primarily includes a bottom container 31 shaped as the bottom container 231 of the base 20, two light sources 32 and two conductors 33 disposed in the bottom container 31, and a top cover 34 covering the light sources 32 and the conductors 33. Each of the front and rear sides of the bottom container 31 is provided with an arc-shaped gear portion 311 and an arc-shaped guiding groove 312. Besides, the bottom container 31 has a transparent bottom plate 313 provided with two slots 314. Each of the light sources 32 is an LED light strip for emitting light toward the transparent bottom plate 313, so that the bottom surface of the transparent bottom plate 313 has a light emitting area 315 located under the light sources 32 for emitting light out. The conductors 33 are springs made of metal and provided with contact portions 331 inserted through the slots 314 respectively to protrude out from the transparent bottom plate 313. One of the conductors 33 is electrically connected to the positive electrodes of the light sources 32 by wires 35 for electrically connecting the positive electrodes of the light sources 32 with the elongated positive electrode 241 of the base 20. The other conductor 33 is electrically connected to the negative electrodes of the light sources 32 by wires 36 for electrically connecting the negative electrodes of the light sources 32 with the elongated negative electrode 242 of the base 20. The slider 30 is disposed in the concave track 25 in a way that the contact portions 331 of the conductors 33 are inserted through the grooves 233 of the base 20 respectively and the curved guides 211 and 221 are slidably disposed in the guiding grooves 312 of the slider 30.

As shown in FIGS. 1-2, the driving mechanism 40 includes a crank 41 provided with a handle 42, and a gear train 43 including first to fifth gears 431-435. The crank 41 is fixed to the first gear 431 by a first axle 436. The first to third gears 431-433 are rotatably disposed on the front surface of the front plate 21, and the second gear 432 is engaged with the first and third gears 431 and 433. The fourth and fifth gears 434 and 435 are rotatably disposed in the recesses 235 of the base 20 respectively and fixedly connected with the third gear 433 by a second axle 437 inserted through the axial hole 236. The fourth and fifth gears 434 and 435 are engaged with the gear portions 311 of the slider 30 respectively.

Figure 6:
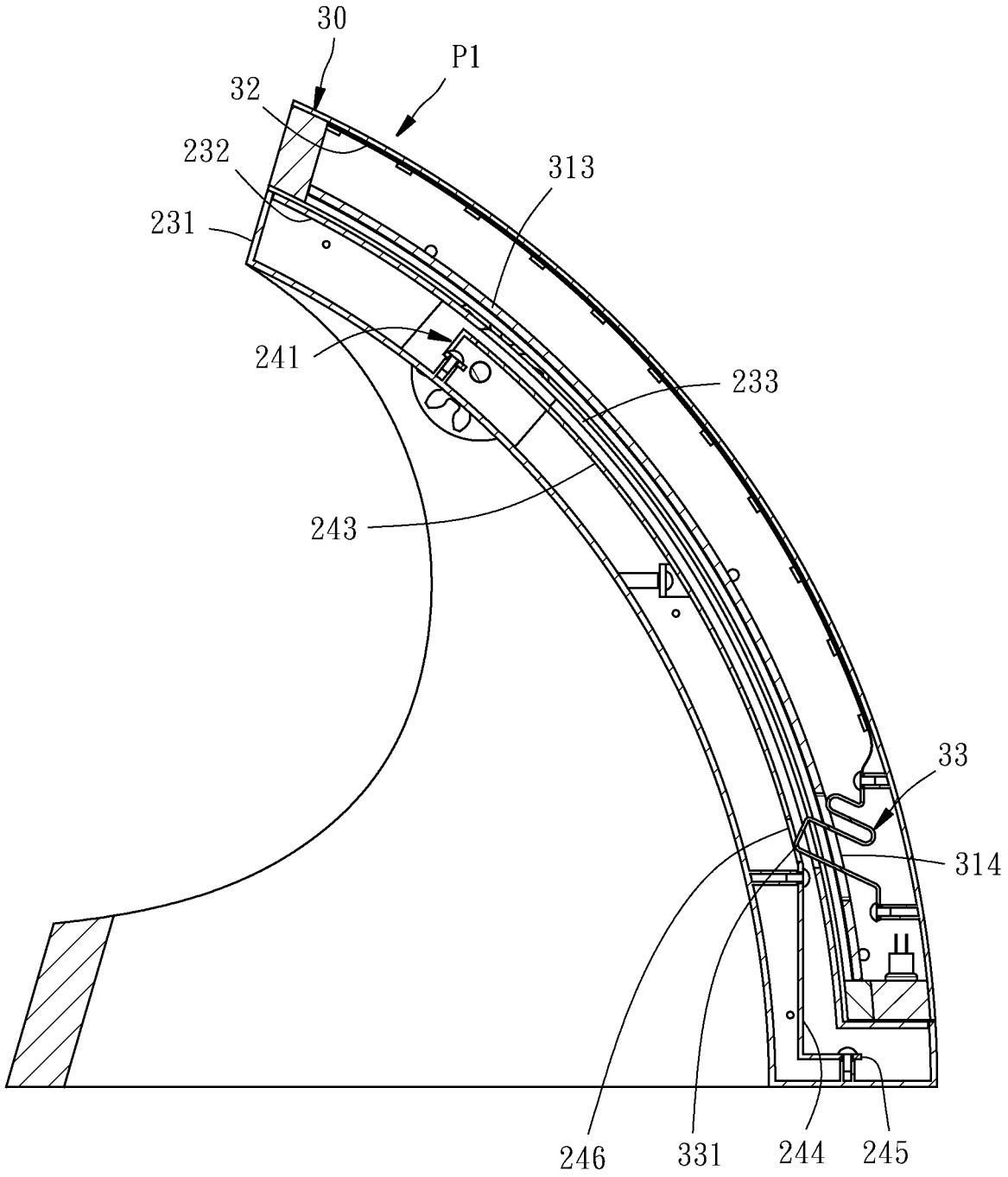
FIG. 6 is a sectional view of the sliding lamp in the state as shown in FIG. 1.
Figure 7:
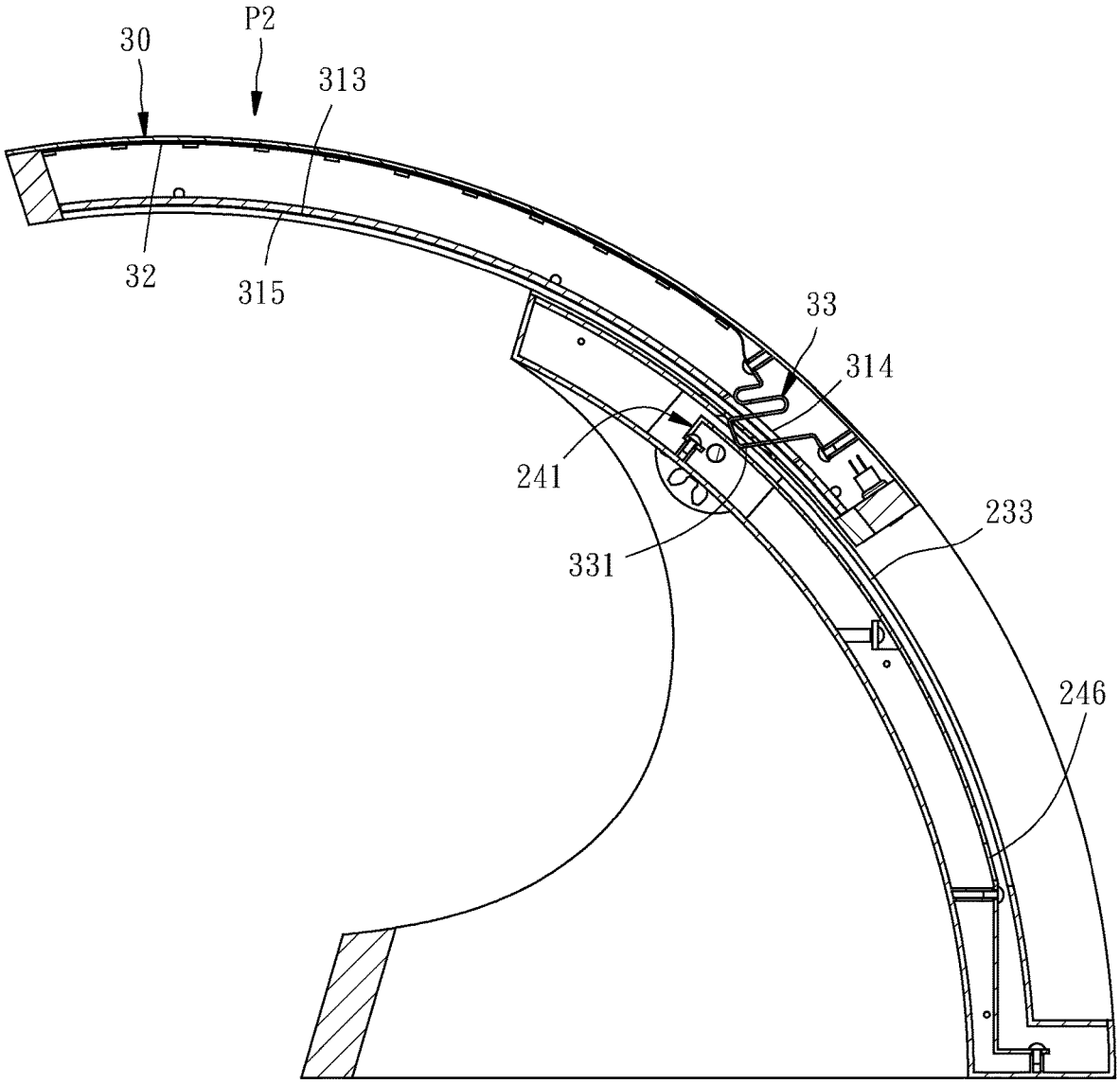
FIG. 7 is a sectional view of the sliding lamp in the state as shown in FIG. 5.

The driving mechanism 40 is adapted for the user to hold the handle 42 to rotate the crank 41 to drive the slider 30 to slide along the track 25 between a closed position P1 as shown in FIGS. 1 and 6 and a wide-open position P2 as shown in FIGS. 5 and 7. When the slider 30 slides, the contact portions 331 of the two conductors 33 displace along the two elongated grooves 233 of the base 20 respectively and the curved guides 211 and 221 of the base 20 displace along the guiding grooves 312 of the slider 30.

When the slider 30 is located at the closed position P1 as shown in FIG. 1, the whole slider 30 is embedded in the concave track 25 of the base 20, and the light emitting area 315 of the slider 30 is completely covered by the base 20. At the same time, as shown in FIG. 6, the contact portions 331 of the conductors 33 are located in the through holes 246 of the electrodes 241 and 242 respectively, so that the conductors 33 are not in contact with the electrodes 241 and 242. Therefore, the light sources 32 are electrically disconnected from the power source and thereby the lamp 10 is turned off.

When the slider 30 is located at the wide-open position P2 as shown in FIGS. 5 and 7 or between the wide-open position P2 and the closed position P1, the contact portions 331 of the conductors 33 are abutted on the electrodes 241 and 242 respectively, so that the light sources 32 are electrically connected with the power source and thereby the lamp 10 is turned on. Additionally, in the process that the slider 30 slides from the closed position P1 to the wide-open position P2, the slider 30 gradually protrudes out of the concave track 25 through the open end 252, so that the light emitting area 315 is gradually exposed. In other words, when the slider 30 slides a little bit toward the wide-open position P2 from the closed position P1 to make the contact portions 331 of the two conductors 33 leave the through holes 246 to be abutted on the electrodes 241 and 242, the light sources 32 are electrically connected with the electrodes 241 and 242, so that the lamp 10 is turned on and emits light from the light emitting area 315. The farther the slider 30 slides from the closed position P1, the more of the light emitting area 315 is exposed and thereby the more light is emitted out. When the slider 30 is located at the wide-open position P2, the most of the light is emitted out and the lamp 10 is in the brightest state.

Figure 8:
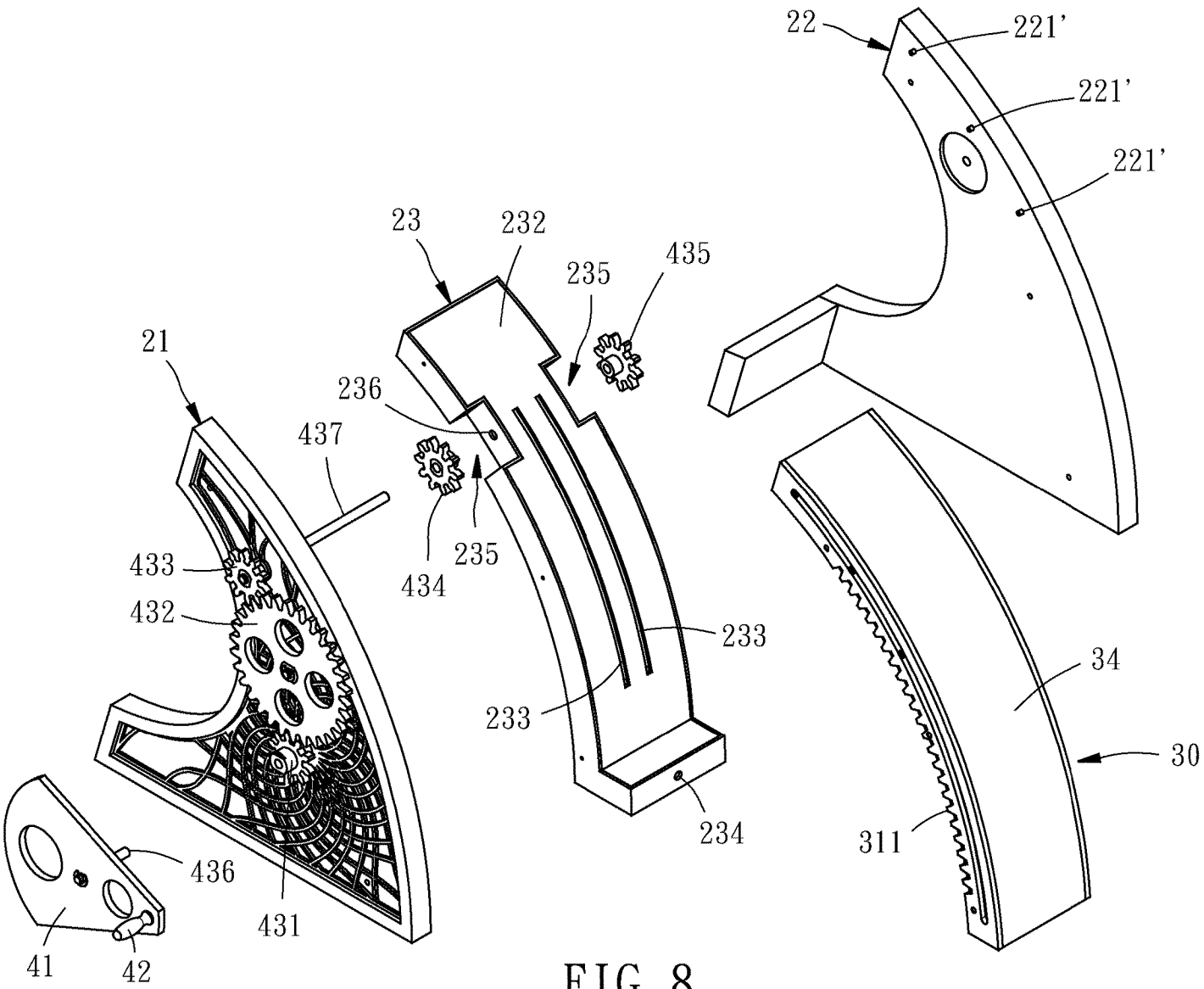
FIG. 8 is similar to FIG. 2, but showing another manner of guiding the slider.

In conclusion, when the sliding lamp 10 is controlled to slide, the lamp 10 may be turned on or off or adjusted in brightness and the shape of the lamp 10 is changed at the same time. In the above-described embodiment, the sliding lamp 10 is controlled manually by the user cranking the driving mechanism 40. However, the sliding lamp of the invention is unlimited thereto. For example, the driving mechanism 40 may be replaced by a motor for driving the slider 30 to slide between the closed position P1 and the wide-open position P2. Besides, the curved guide 221 of the rear plate 22 may be replaced by a plurality of protrusions such as three protrusions 221' as shown in FIG. 8, and the curved guide 211 of the front plate 21 may be also replaced by a plurality of protrusions (not shown). However, the pair of curved guides 211 and 221 used in the above preferred embodiment, which may be made of plastic bearing material, are relatively more advantageous to the smoothness of operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sliding lamp comprising:

a base provided therein with an electric conductive unit; and a slider provided therein with a light source and having a light emitting area for emitting light out, the slider being disposed on the base in a way that the slider is slidable relative to the base between a closed position and a wide-open position;

wherein when the slider is located at the closed position, the light emitting area of the slider is completely covered by the base and the light source is electrically disconnected from the electric conductive unit of the base; in the process that the slider slides from the closed position to the wide-open position, the light source is electrically connected with the electric conductive unit of the base and the light emitting area is gradually exposed, and wherein the electric conductive unit comprises an elongated positive electrode and an elongated negative electrode each provided with a through hole; the slider comprises two conductors electrically connected with the light source and each having a contact portion; when the slider is located at the closed position, the contact portions of the two conductors are located in the through holes of the elongated positive electrode and the elongated negative electrode respectively; when the slider is located at the wide-open position or between the wide-open position and the closed position, the contact portions of the two conductors are abutted on the elongated positive electrode and the elongated negative electrode respectively.

2. The sliding lamp as claimed in claim 1, wherein the base has a concave track provided with a closed end and an open end; the slider is disposed in the concave track; when the slider is located at the closed position, the slider is completely located between the closed end and the open end of the concave track; in the process that the slider slides from the closed position to the wide-open position, the slider gradually protrudes out of the concave track through the open end.

3. The sliding lamp as claimed in claim 2, wherein the concave track of the base and the slider are both arc-shaped; the open end and the closed end of the concave track are located at a top and a side of the base respectively.

4. The sliding lamp as claimed in claim 1, wherein the base has a top cover covering the electric conductive unit and having two elongated grooves located correspondingly to the elongated positive electrode and the elongated negative electrode respectively; when the slider slides, the contact portions of the two conductors displace along the two elongated grooves respectively.

5. The sliding lamp as claimed in claim 4, wherein the slider has a transparent bottom plate located between the light source and the top cover of the base and having the light emitting area; the contact portions of the two conductors protrude out from the transparent bottom plate.

6. The sliding lamp as claimed in claim 1, wherein the slider is driven by a driving mechanism which comprises a gear train disposed on the base; the slider has a gear portion engaged with the gear train.

7. The sliding lamp as claimed in claim 6, wherein the driving mechanism comprises a crank provided with a handle and fixed to a gear of the gear train.

* * * * *